US008955729B2

(12) United States Patent
Gleason

(10) Patent No.: US 8,955,729 B2
(45) Date of Patent: Feb. 17, 2015

(54) BACKPACK WITH SIDE BOLSTERS

(75) Inventor: Dana W. Gleason, Bozeman, MT (US)

(73) Assignee: Mystery Ranch Limited, Bozeman, MT (US)

( * ) Notice: Subject to any disclaimer, the term of this patent is extended or adjusted under 35 U.S.C. 154(b) by 0 days.

(21) Appl. No.: 13/408,792

(22) Filed: Feb. 29, 2012

(65) Prior Publication Data

US 2013/0140337 A1 Jun. 6, 2013

Related U.S. Application Data

(63) Continuation-in-part of application No. 12/032,541, filed on Feb. 15, 2008, now Pat. No. 8,162,194.

(51) Int. Cl.

| | |
|---|---|
| ***A45F 3/00*** | (2006.01) |
| ***A45F 3/04*** | (2006.01) |
| ***A45F 3/08*** | (2006.01) |
| *A45F 3/12* | (2006.01) |

(52) U.S. Cl.

CPC ... *A45F 3/04* (2013.01); *A45F 3/08* (2013.01); *A45F 2003/122* (2013.01)

USPC ..... 224/628; 224/644; 224/637; 224/633

(58) Field of Classification Search

USPC ..... 224/642, 644, 650–652, 153, 627–630, 224/633, 645

See application file for complete search history.

(56) References Cited

U.S. PATENT DOCUMENTS

| | | | | |
|---|---|---|---|---|
| 4,318,502 | A * | 3/1982 | Lowe et al. | 224/153 |
| 4,324,012 | A * | 4/1982 | Cannaday | 5/656 |
| 5,894,977 | A * | 4/1999 | Krueger et al. | 224/627 |
| 6,193,122 | B1 * | 2/2001 | Buckley | 224/270 |
| 6,607,107 | B2 * | 8/2003 | Dexheimer | 224/604 |
| 6,820,783 | B2 * | 11/2004 | Beale | 224/644 |
| 2004/0134955 | A1 * | 7/2004 | Williams | 224/644 |
| 2005/0205634 | A1 * | 9/2005 | Han | 224/644 |
| 2006/0163305 | A1 * | 7/2006 | Tong | 224/628 |
| 2006/0208024 | A1 * | 9/2006 | Gleason | 224/633 |

* cited by examiner

*Primary Examiner* — Brian D Nash
*Assistant Examiner* — Corey Skurdal
(74) *Attorney, Agent, or Firm* — Lowe Graham Jones PLLC

(57) ABSTRACT

A backpack includes a stabilizing and ventilating side bolsters coupled to a frame. The side bolsters are secured to the frame by being received in sleeves or by straps having clips disposed through slots in the side bolsters. A particular side bolster includes at least one channel to allow air flow away from the back side of the wearer. The side bolster is comprised of high-density foam to stabilize the backpack under load while providing improved ventilation. The side bolsters have a center axis that is spatially separated in a forward direction from a surface of the frame to allow the side bolsters to contour around the back side of the wearer. The side bolsters may be formed for a particular environment, body type, or loads to be carried in the backpack by changing the stiffness, density, material, dimensions or other aspects of the side bolsters.

7 Claims, 12 Drawing Sheets

BACKPACK WITH SIDE BOLSTERS

PRIORITY CLAIM

This application constitutes a continuation-in-part of co-pending, commonly-owned U.S. application Ser. No. 12/032,541 filed on Feb. 15, 2008, the contents of which are incorporated by reference.

FIELD OF THE INVENTION

This invention relates generally to a backpack with side bolsters and, more specifically, to side bolsters for stabilizing the backpack and providing ventilation between the backpack and a wearer of the backpack.

BACKGROUND OF THE INVENTION

Conventional backpacks are generally configured with either an internal or external frame coupled to a compartment for carrying gear, such as, but not limited to clothing, food, water bottles and sleeping gear. Internal frame backpacks are generally more stable, but the weight or load of the gear in the load compartment should be selectively distributed to help improve the vertical and rotational stability of the backpack relative to a wearer. By way of example, one type of conventional internal frame backpack includes flexible stays arranged within frame material. The flexible stays may be arranged vertically, horizontally, or in some other direction in an attempt to transfer the load in the load compartment to the shoulder straps and the waist belt of the backpack.

Stabilizing the backpack on the wearer, maintaining a desired amount of ventilation between the backpack and the wearer, and providing a comfortable fit after the backpack has been loaded and strapped onto the wearer has always been some of the primary challenges in designing and configuring a backpack. In some environments, where heavy backpack loads are required or where the backpack is to be worn with other gear, such as body armor in a military environment, the above-identified design challenges become even more difficult to overcome. By way of example, backside armor is generally curved or contoured to at least somewhat conform to the general shape of a soldier's back. Conventional backpacks tend to ride on and slide relative to the backside armor. Under heavy load conditions, such as when the backpack includes a substantial amount of weight (e.g., food, clothing, ammunition, communications gear, etc.), the backpack may become unstable relative to the backside armor. To stabilize the backpack, soldier's often have to highly tighten the waist belt, which in turn presses the backside armor into the soldier's back and entraps body heat.

U.S. Patent Publication No. 2005/02025634 to Han describes cushion pads for backpacks. Each cushion pad includes a porous filter which is placed inside the net fabric to dissipate heat to the atmosphere, and a sheet which is made of a material such as polyurethane and layered on a surface of the porous filter. The sheet is inserted along with the porous filter into a space defined between the net fabric and the cloth of the backpack. Han suggests that the cushion pads provide improved ventilation and elasticity to the backpack and the shoulder straps of the backpack.

U.S. Patent Publication No. 2004/0134955 to Williams describes a ventilation system that may be attached to a conventional backpack. The ventilation system elevates the backpack, hydration pack, fanny pack, or the like off the wearer's skin. The ventilation system includes pliable supports that provide for pressure relief and good ventilation between a wearer's back and the conventional backpack. Williams suggests that the purpose of the invention is to support and elevate the backpack off of the wearer's skin or other bodily part in order to reduce the pack's surface area in contact with the wearer, thusly increasing ventilation and exposed wearer's body surface area to maximize cooling, therefore reducing perspiration and water consumption, while increasing performance, comfort, and physical and mental endurance.

Japanese Patent No. JP09252840 by Shigeharu describes a back panel and cushioning system that includes a back panel that couples to the backpack. The back panel substantially over a width of the wearer's back and includes left and right edges that are curved in a direction away from the back. Cushioning devices are coupled to the left and right edges and generally extend from an upper edge to a lower edge of the back panel. Shigeharu suggests that the space created between the back panel and the wearer's back because the cushioning devices offset the backpack from the wearer's back provides improved ventilation.

SUMMARY OF THE INVENTION

The present invention generally relates to a backpack having stabilizing and ventilating side bolsters, and a method for securing and releasing the side bolsters. In accordance with an aspect of the invention, a backpack includes a frame; a load compartment coupled to the frame; shoulder straps coupled to the frame; and a pair of side bolsters coupled to the frame by fastening devices.

The side bolsters are comprised of a semi-rigid material, such as high-density polyurethane or polystyrene foam. The side bolsters include a plurality of channels to allow air flow through the side bolsters and away from the wearer. The side bolsters may be firmly coupled to the frame by fastening devices including a combination of straps and clips disposed either through slots in the side bolster or around the perimeter of the side bolster. In a preferred embodiment, the density of the side bolsters is in the range of 0.5 $lbs/ft^3$ to 10.0 $lbs/ft^3$, in a more preferred embodiment the range of density is 2.0 to 4.0 $lbs/ft^3$.

The side bolsters function to cooperate with the frame and stabilize the backpack under load while providing improved ventilation between the backpack and a back side of a wearer of the backpack. The side bolsters have a center axis oriented substantially vertically to structurally cooperate with the frame in providing stability for the load compartment. The center axes of the side bolsters are spatially separated in a forward direction from the forward surface of the frame. The side bolsters thereby contour around the backside of the wearer to provide stability for the load compartment and to allow ventilation.

The channels may be formed in a circular or oval cross-section to provide stabilizing support for the backpack while allowing air flow in a direction away from the forward surface of the backpack. The channels are formed laterally from one side of the side bolster to the other side to permit air flow away from the backside of the wearer. By way of example, the side bolsters may be formed for a particular environment, for a particular body type, or for particular loads to be carried in the backpack. For example, the side bolsters may be manufactured with a variable stiffness, size, material, density, and other aspects of the side bolsters.

In accordance with another aspect of the invention, a stabilizing system for a backpack includes the pair of side bolsters made from a semi-rigid material, and a pair of sleeves coupled to the backpack and sized to receive the side bolsters. The sleeves are made from a breathable material, wherein a side bolster is arranged in a sleeve to provide an amount of vertical stabilization to the backpack. The sleeves are horizontally spaced apart from each other by approximately the width of the back pad and the sleeves are oriented approximately vertically. The sleeves are made from a breathable material and the side bolsters cooperate with the sleeves to move air from the back pad area and away from the spaced apart region formed by the sleeves in a direction away from the back pad. The sleeves may include a zipper for opening the sleeve to access the side bolsters for removal. Alternatively, the sleeve may include other means of securing the side bolster to the backpack, such as a hook and loop fastener or snap buttons.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

In the following description, certain specific details are set forth in order to provide a thorough understanding of various embodiments of the invention. However, one skilled in the art will understand that the invention may be practiced without these details or with various combinations of these details. In other instances, well-known structures and methods associated with backpacks, backpack frames, shoulder and waist harness systems, and various other accessory items usable with a backpack may not be shown or described in detail to avoid unnecessarily obscuring descriptions of the embodiments of the invention. The term backpack as used herein generally refers to a soft-covered carrier designed for carrying belongings or items on a person's back within the carrier. In addition, the term backpack, as used herein, includes, but is not limited to, carriers that may be referred to by other names such as a rucksack, knapsack, pack, carrier, bag, and daypack.

As will be described in further detail below, at least one embodiment of the invention includes a backpack having stabilizing and ventilating side bolsters coupled to a frame. The backpack may be configured to operate in a variety of environments such as a in the military, on a climbing, hiking, or camping trip, or for general traveling. The side bolsters function to cooperate with the frame and stabilize the backpack under load while providing improved ventilation between the backpack and a back side of a wearer of the backpack. Stabilizing the backpack includes reducing or even preventing bulging when the backpack is under load. By way of example, the side bolsters may be formed for a particular environment, for a particular body type, or for particular loads to be carried in the backpack. Stabilization also includes retaining the position of the pack relative to the body (and any body armor) of the wearer. Thus, the bolsters aid the side-to-side position retention (both lateral shifting and rocking) of the pack relative to the wearer.

Figure 1:
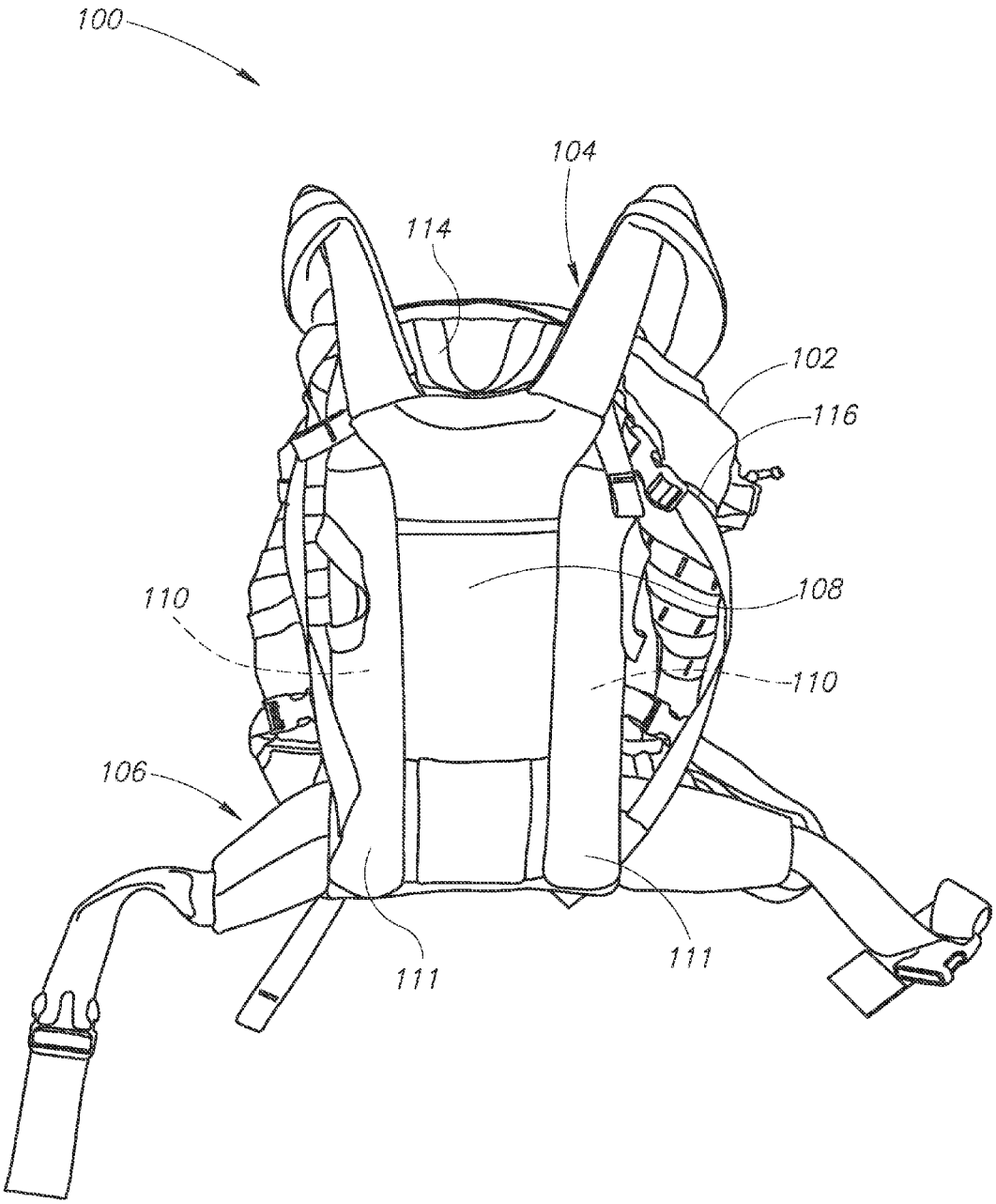
FIG. 1 is a rear elevational view of a backpack with a side bolster assembly according to an illustrated embodiment of the present invention.
Figure 2:
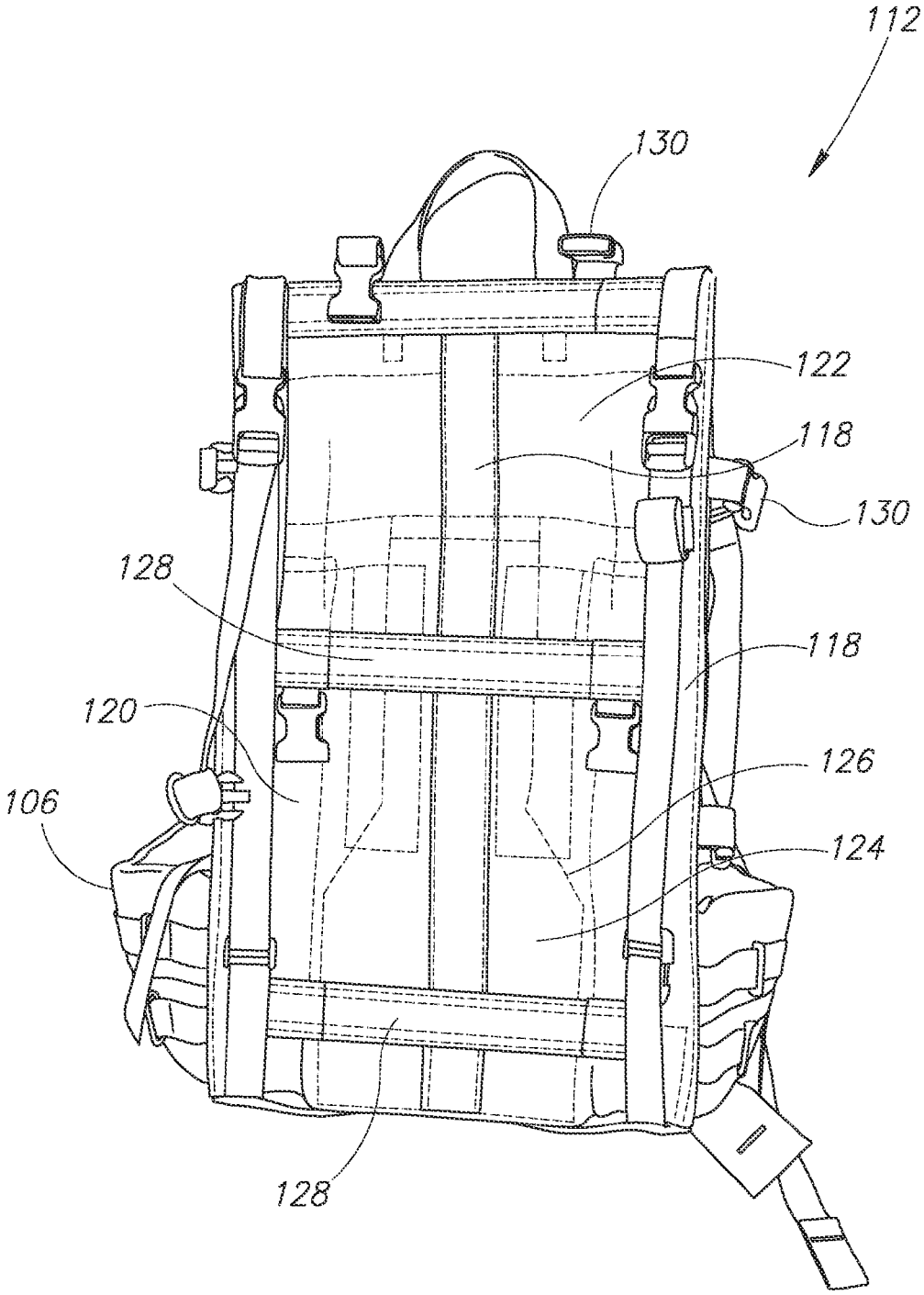
FIG. 2 is rear elevational view of a frame for the backpack of FIG. 1 according to an illustrated embodiment of the present invention.

FIG. 1 shows a backpack 100 having a load compartment 102 coupled to a shoulder harness 104 and a waist belt 106. In the illustrated embodiment, the backpack includes a back pad 108 coupled to vertically oriented side bolsters 110, which are retained in vertically oriented breathable sleeves 111. The load compartment 102 structurally couples to a frame 112 (FIG. 2). The backpack may further include a carrying handle 114, compression straps 116, and other accessory items that may take the form of webbing, straps, clips, zippers, pads, etc.

FIG. 2 shows the frame 112 that may be used to support the load compartment 102 according to an illustrated embodiment of the invention. The frame 112 includes flexible, yet sufficiently rigid vertically oriented stays 118 received in stitched pockets 120 of a soft covering 122. In one embodiment, the frame 112 may include a semi-rigid back plate 124 located in a lower stitched pocket 126. Further, the frame may include horizontally oriented stays 128, which may be structurally coupled or integrally formed with the vertically oriented stays 118. In the illustrated embodiment, the frame 112 is connected to the waist belt 106 and further includes connection devices 130 for coupling to the load compartment 102.

The illustrated frame 112 is commonly referred to as a "soft-frame" because the stays are flexible enough to form and generally move with the wearer, yet structurally strong and stiff enough to support the load compartment 102, shoulder harness 104, and waist belt 106 even when the load compartment 102 contains a substantial amount of weight, for example more than thirty pounds (30 lbs.). The length, width, thickness, and material of the stays 118, 128 may be selected depending on a desired purpose of the backpack 100.

Figure 3:
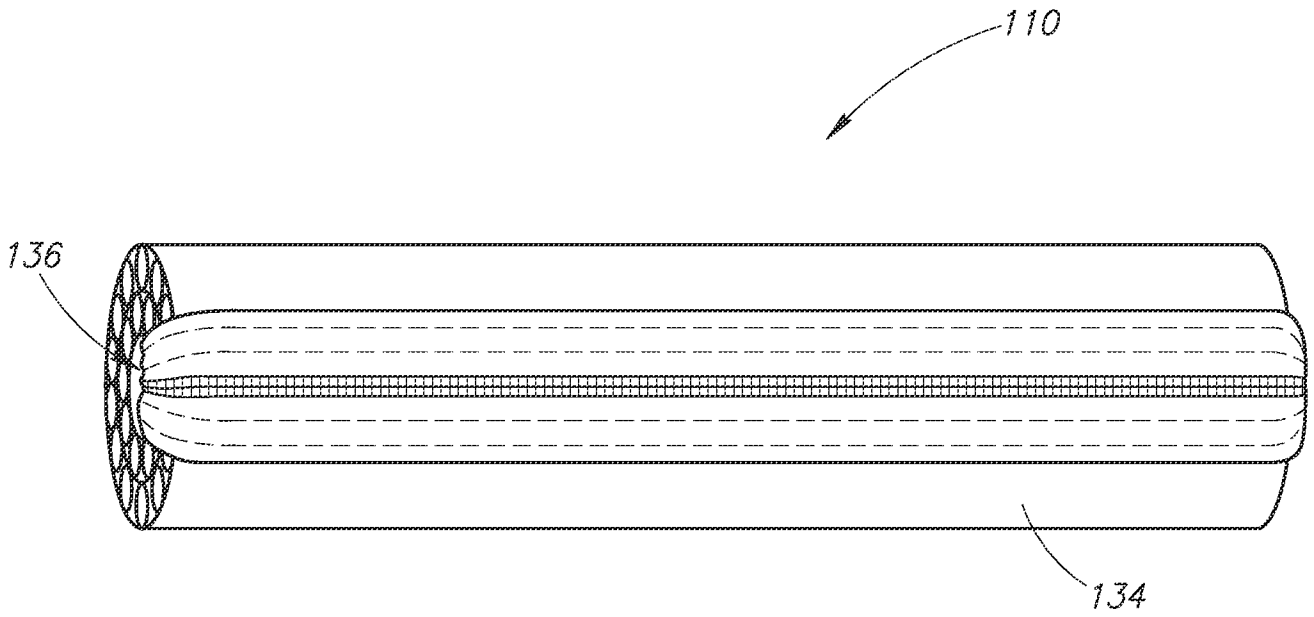
FIG. 3 is a isometric view of a side bolster in a rolled configuration according to an illustrated embodiment of the present invention.

FIGS. 3-5 show the side bolster 110 in both a rolled configuration (FIGS. 1 and 3) and in an unrolled configuration (FIG. 2) according to an illustrated embodiment of the present invention. When placed in the breathable sleeves 111 (FIG. 1)

of the backpack 100 (FIG. 1), the side bolster 110 would be in the rolled configuration. The rolled configuration permits the side bolster 110 to have a desired amount of bending stiffness, buckling strength, and structural stability for the purpose of cooperating with the frame 112 (FIG. 2) and helping to stabilize the load compartment 102 (FIG. 1) of the backpack 100 (FIG. 1). Another purpose of the side bolster 110 is to offset or space the backpack 100 away from the back of the wearer. In one application, the side bolsters 100 have been found to be advantageous on military-style backpacks to stabilize the backpack 100 while maintaining the backpack 100 away from or nested and contoured with an armored plate (not shown) worn on the backside of a soldier (not shown). As will be described in greater detail below, the side bolster 110 may be radially compressible, yet remain breathable to provide ventilation and have a cross-sectional stiffness that helps stabilize the backpack 100 with respect to the wearer.

In one embodiment, a first side portion 132 is coupled to a mid portion 134 of the side bolster 110. By way of example, the first side portion 132 may be coupled to the mid portion 134 with a fastening system 136, for example a zipper device, a hook and loop fastening system (e.g., VELCRO®), an adhesive or bonding agent, or an equivalent system. However, the side bolster 110 does not have to be coupled together with the fastening system 136 to hold its rolled configuration because the side bolster 110 may be rolled and then placed into the breathable sleeve 111 (FIG. 1). In turn, the sleeve 111 is sized to maintain the side bolster 110 substantially in the rolled configuration.

Figures 4A, 4B:
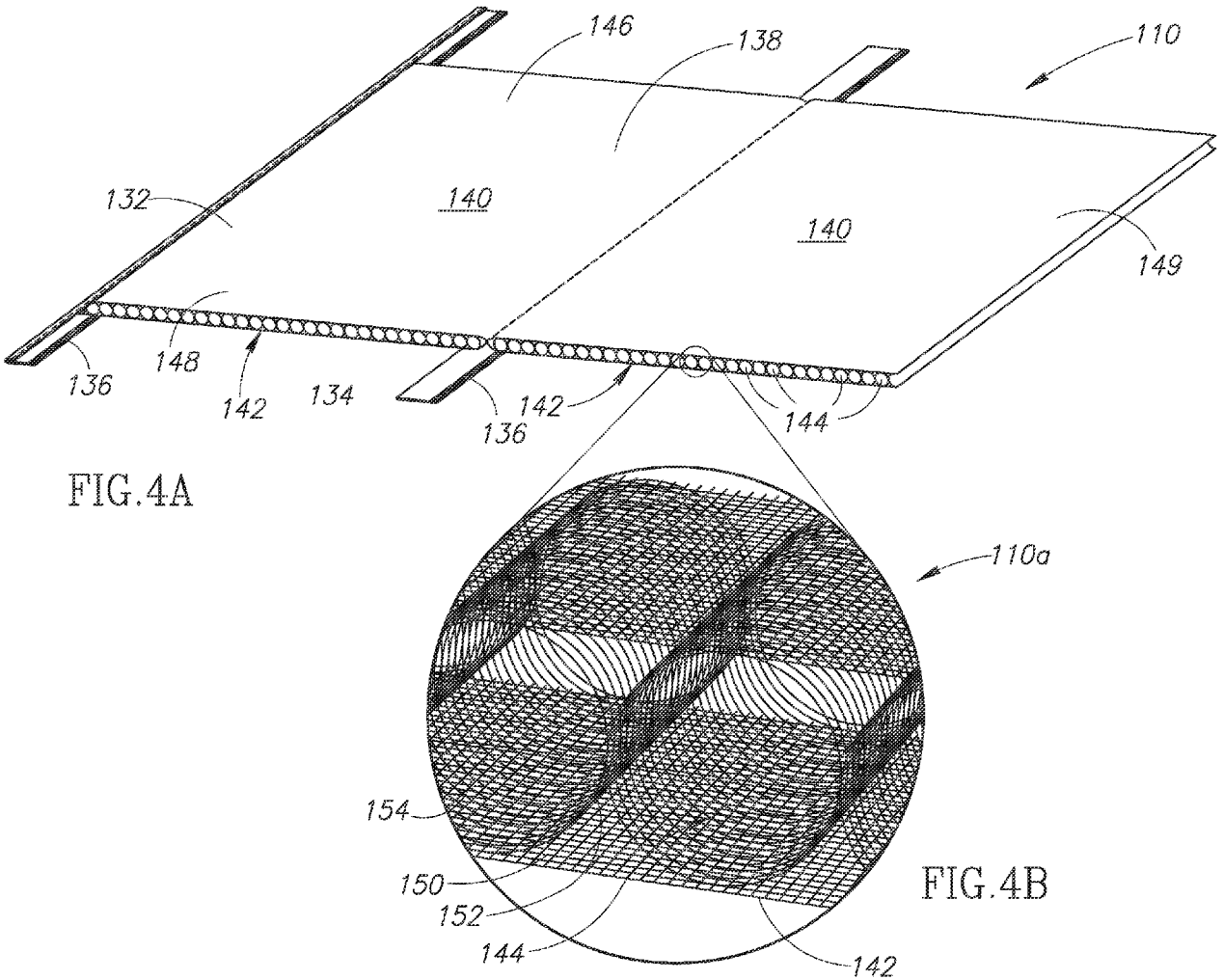
FIG. 4A is a isometric view of a side bolster in an un-rolled configuration according to an illustrated embodiment of the present invention.
FIG. 4B is a close-up view of a portion of the side bolster of FIG. 4A.

Referring to FIG. 4A, the side bolster 110 may be made from a woven, synthetic material 138 that when rolled and/or radially compressed still allows for airflow through the material 138. By way of example, the side bolster 110 is made from a woven, polypropylene or polyethylene fabric or an open-celled foam having a first surface 140 spaced apart from a second surface 142 by a plurality of woven channels 144. Each channel 144 extends from a bottom end portion 146 to a top end portion 148 of the material 138. The material 138 may be a woven geotextile polypropylene fabric commercially available under the trademark PROPEX®. In the illustrated embodiment, the side bolster 110 includes a generally circular cross-section, but it is appreciated that the cross-sectional profile of the side bolster 110 may take a variety of forms or shapes. For purposes of clarity, the structural details of the side bolster 110 are shown in FIG. 4B. Although FIG. 4A is shown with the side bolster 110 in an un-rolled configuration for purposes of clarity, it is appreciated that the side bolster 110 may be completed by rolling a second side portion 149 towards the first side portion 132 and then either inserting directly into the breathable sleeve 111 (FIG. 1) or using the fastening system 136 to maintain the side bolster 110 in the rolled configuration.

FIG. 4B shows a close-up view of a portion 110*a* of the side bolster 110 of FIG. 4A. In one embodiment, the side bolster 110 is a porous, mesh or breathable material 138 having a plurality of holes or openings 150. In addition, the material 152 defining the channels 144 is made from the same porous, mesh or breathable material 138 and includes a plurality of holes or openings 154.

Figure 5A:
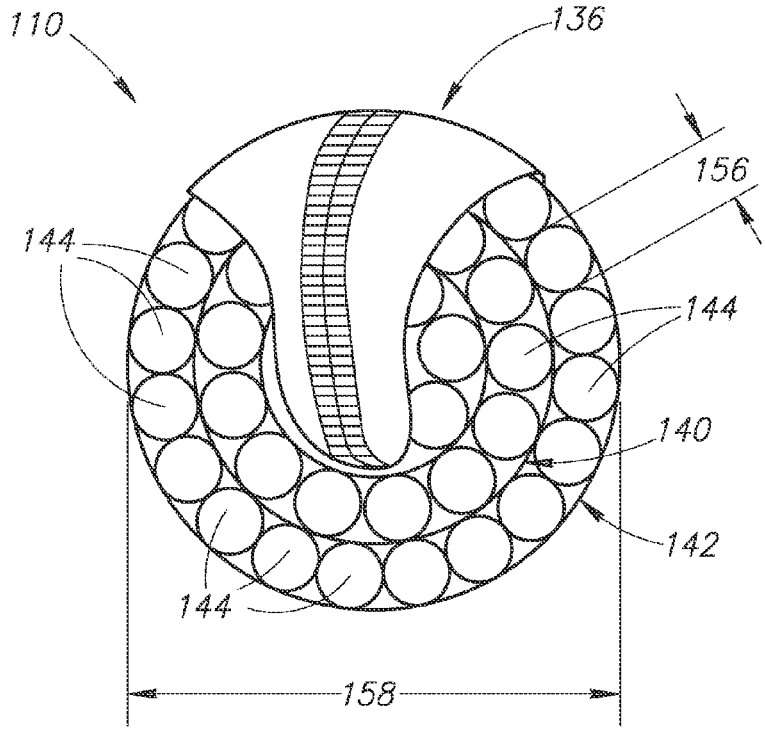
FIG. 5A is a top view of the side bolster of FIG. 3.

FIG. 5A shows the side bolster 110 in the rolled configuration and being held in that configuration by the fastening system 136 according to an illustrated embodiment of the present invention. Many aspects of the side bolster 110 may be varied to customize the side bolster 110 for a particular purpose. By way of example, the type of material 138, 152 may have more or less stiffness than the materials described above, have a greater density or porosity (e.g., larger openings 150, 154), the channels 144 may be have a larger or smaller diameter 156 or may even have different size diameters (e.g., a first channel diameter size in one portion of the side bolster and a second channel diameter size in another portion of the side bolster), and an overall diameter 158 of the side bolster 110 may be changed to effect the stiffness, breathability, or both of the side bolster 110.

Figure 5B:
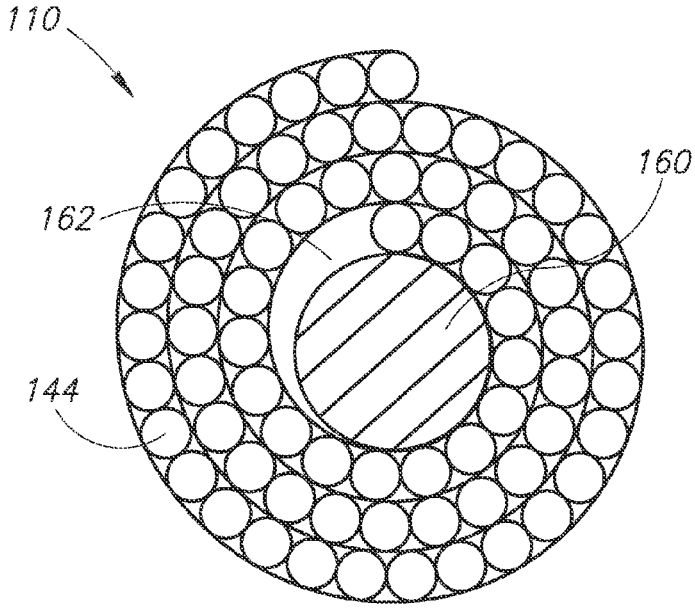
FIG. 5B is a top view of a side bolster having a spacer according to another illustrated embodiment of the present invention.

FIG. 5B shows the side bolster 110 in the rolled configuration, without the fastening system 136, and having an spacer or internal support rod 160 according to an illustrated embodiment of the present invention. The spacer 160 may take the form of an anti-buckling rod or stiffness enhancing rod, for example. The spacer 160 may be rolled up into the side bolster 110 or inserted through a central channel 162 after it has been rolled up.

Side bolsters 110 may alternatively be constructed of other materials. Closed or open cell materials may be used, including rubber or foam. The density can be selected based on the load to be carried. The stiffness may vary based on the selection of the bolster material as well. The material may be rolled from a sheet form, as discussed above, or may be one or more blocks of material stacked together vertically or otherwise. The material may be progressively more dense or stiff as it extends away from the back of the user or may vary vertically in compressibility. Various materials and material arrangements may be employed to meet the needs of the load and the user.

Briefly referring back to FIG. 1, the side bolsters 110 are received in elongated, breathable sleeves 111. The sleeves 111 may extend vertically over a substantial portion of the backpack 100 or may be truncated to have a shorter height, for example a height approximately equivalent to a height of the waist belt 106. Further, the sleeves 111 may take the form of a plurality of sleeves vertically aligned with one another and extending over the substantial portion of the backpack 100 or may be arranged in other configurations on the backpack 100. In one embodiment, the sleeves 111 are made from a woven fabric in which the selected weave pattern permits a substantial amount of airflow through the sleeves 111.

Figure 6:
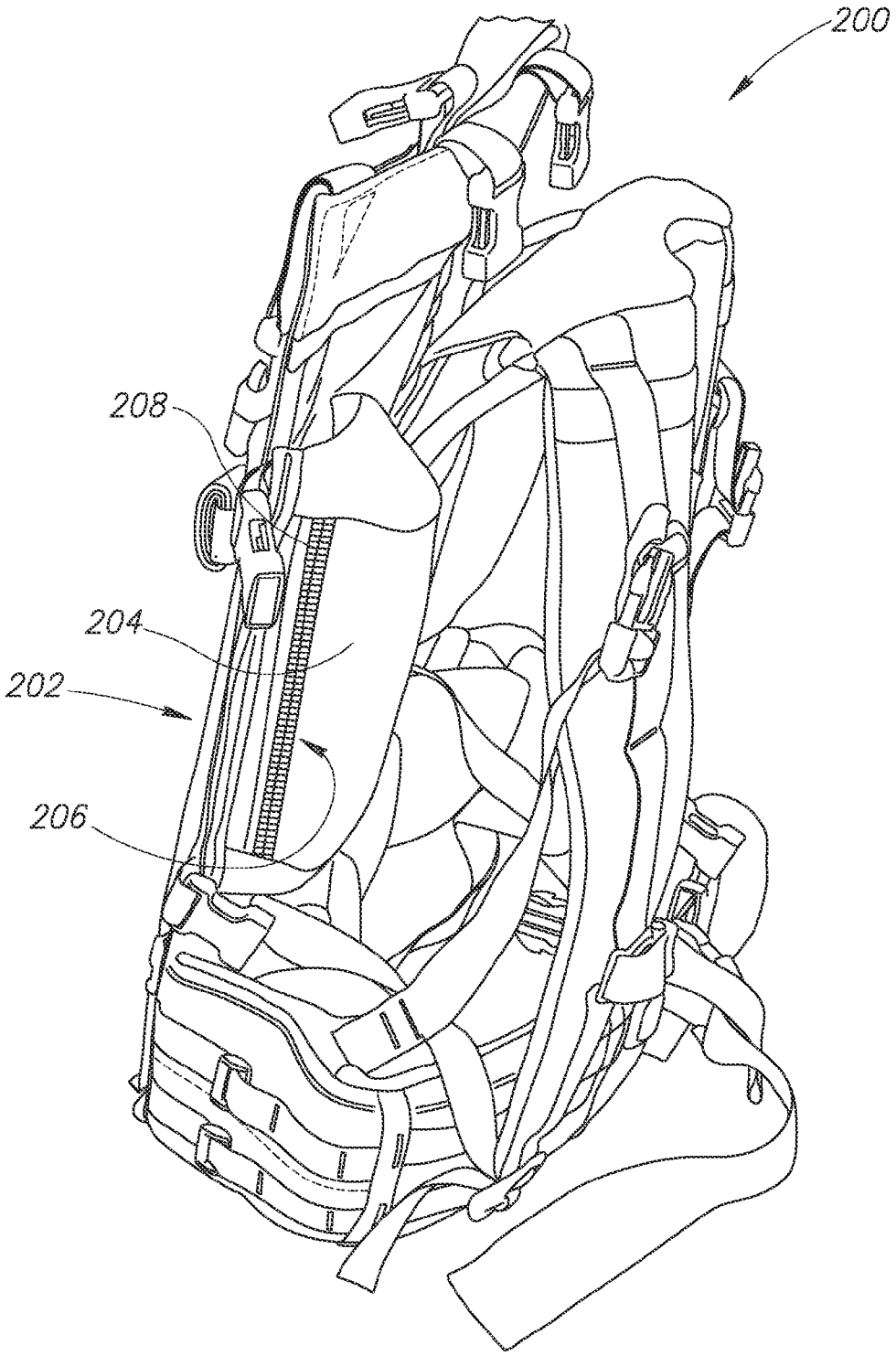
FIG. 6 is a side perspective view of a backpack having a side bolster assembly according to another illustrated embodiment of the present invention.

FIG. 6 shows a backpack 200 coupled to a bolstered ventilation and stabilization system 202 according to an illustrated embodiment of the present invention. The bolstered ventilation and stabilization system 202 includes side bolsters (not shown), such as the side bolster 110 described above, received in breathable sleeves 204. The breathable sleeve 204 includes an access system 206 for gaining access to inside the sleeve 204 and specifically for gaining access to the side bolster (not shown). In the illustrated embodiment, the access system 206 takes the form of a side zipper 208 extending along at least a substantial length of the sleeve 204. However, the access system 206 may take other forms such as a top flap, top or bottom zipper, an internal zipper accessible from within the backpack 200, or other equivalent embodiments.

Figure 7:
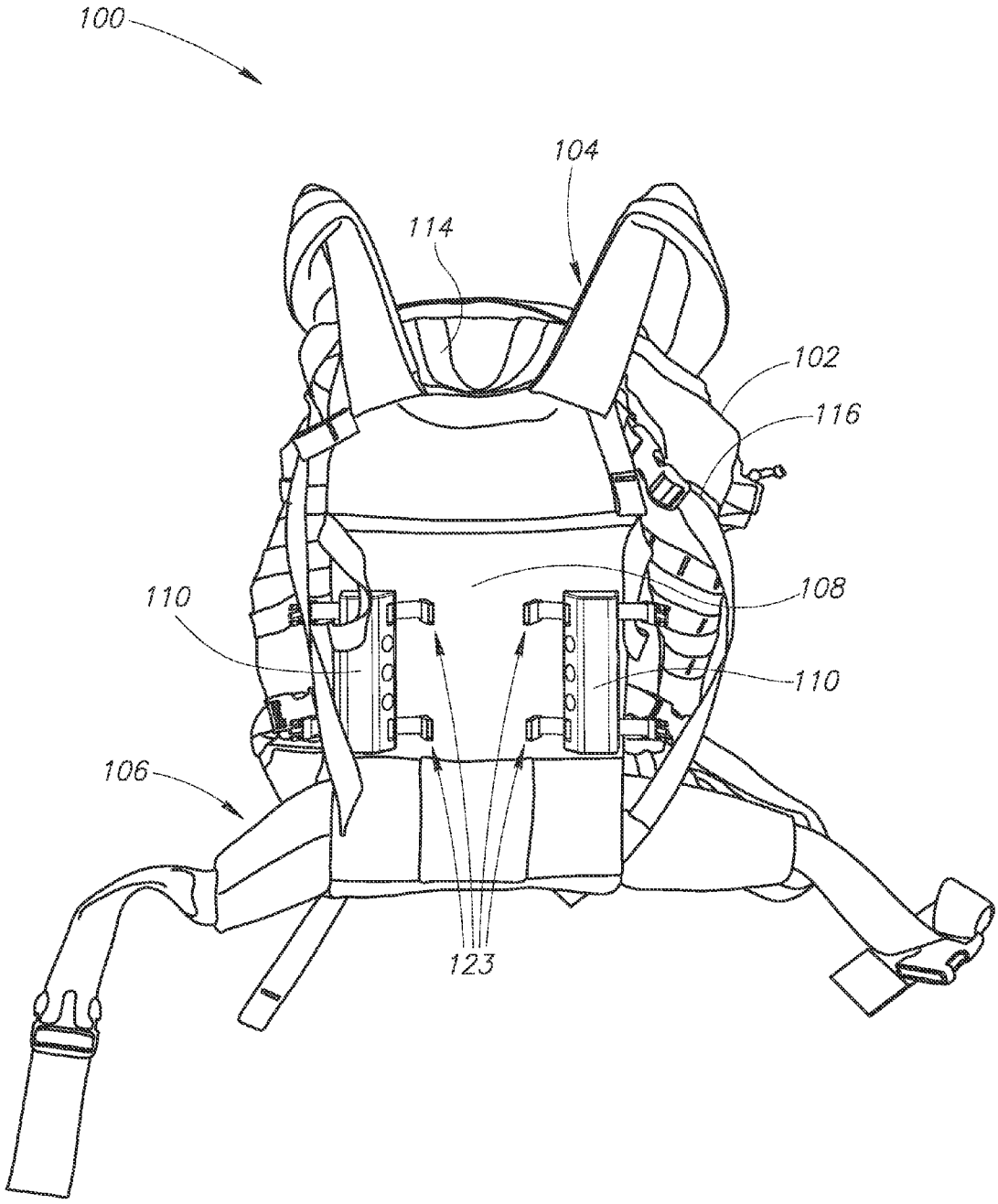
FIG. 7 is a rear elevational view of a backpack with side bolsters made of semi-rigid material according to an illustrated embodiment of the present invention, showing the straps and clips unsecured.
Figure 8:
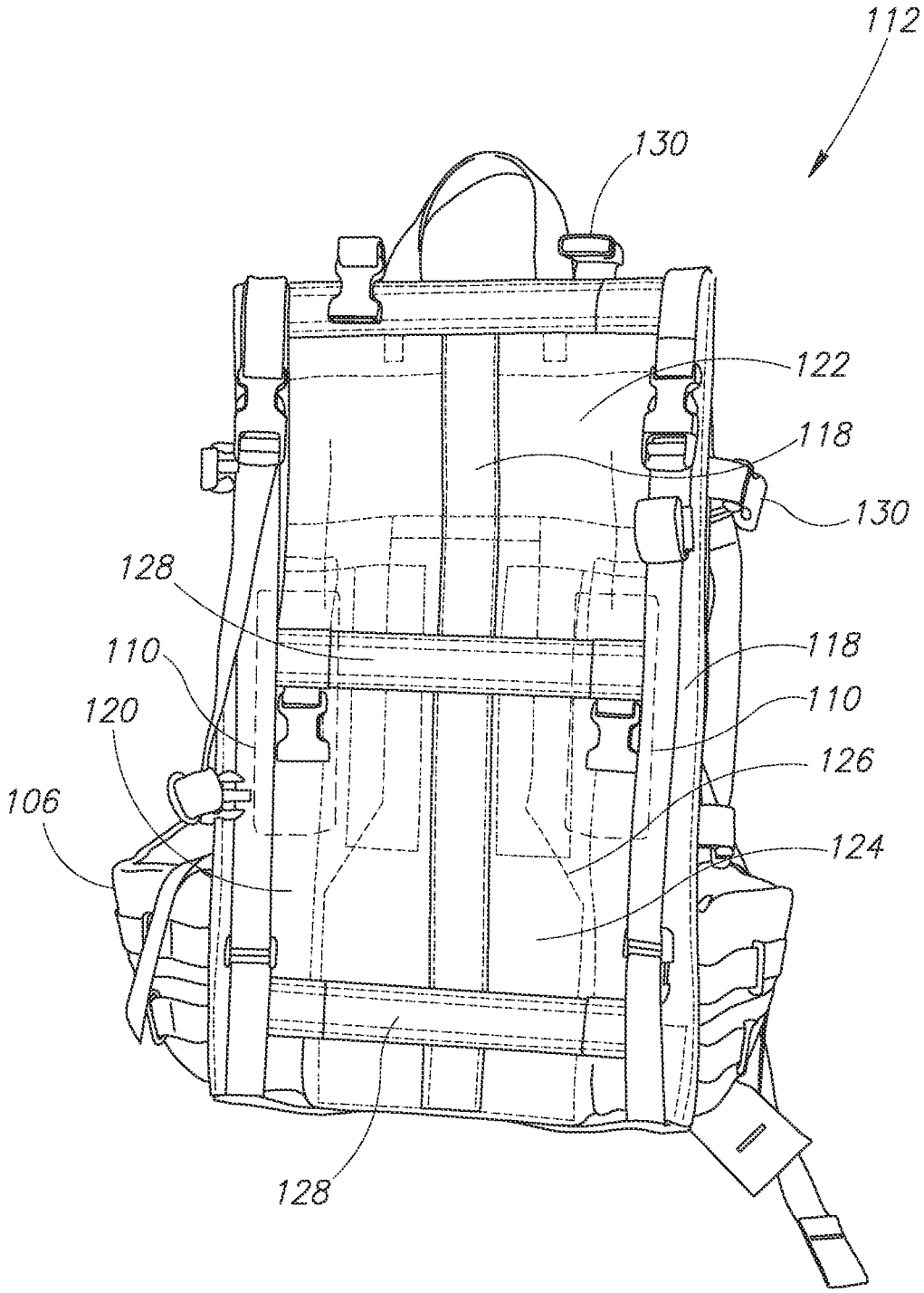
FIG. 8 is rear elevational view of a frame for the backpack of FIG. 7 according to an illustrated embodiment of the present invention.
Figure 9A:
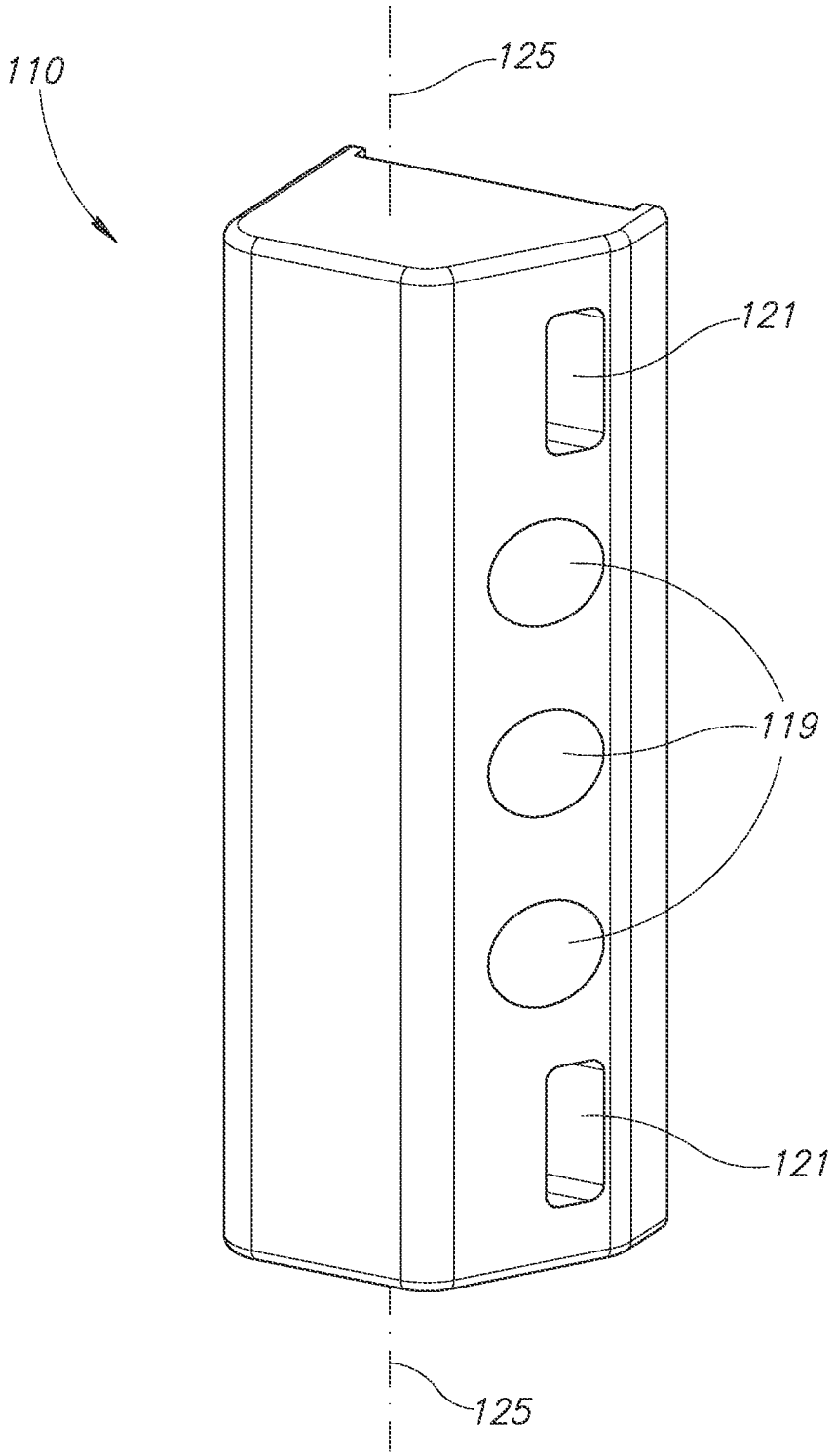
FIG. 9A is an isometric view of a side bolster made of semi-rigid material according to an illustrated embodiment of the present invention of FIG. 7.
Figure 9C:
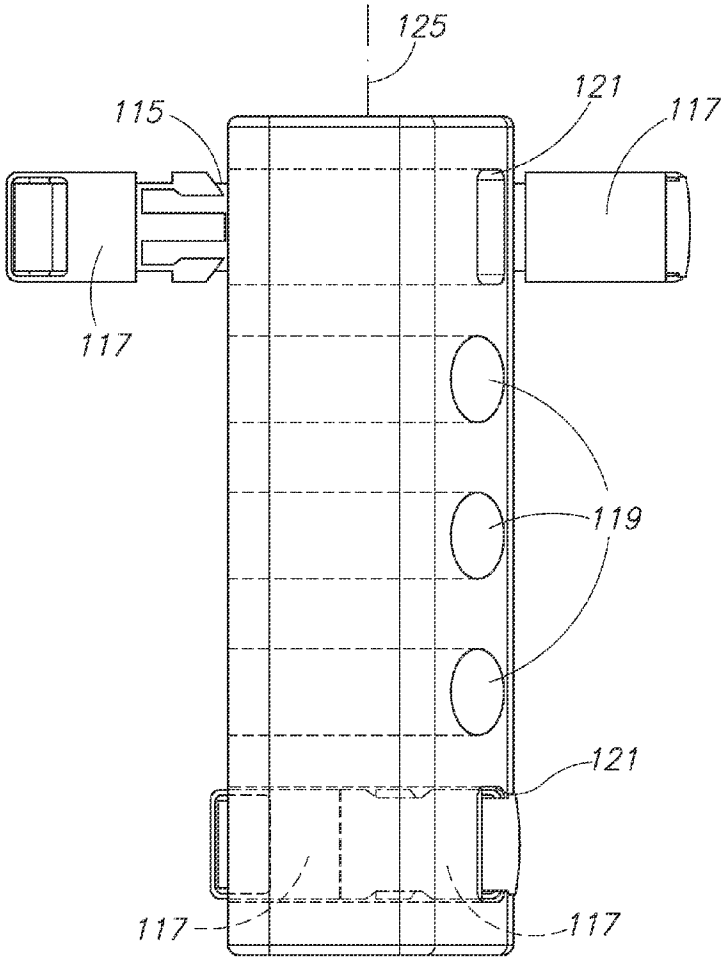
FIG. 9C is a rear elevation view of the side bolster of FIG. 9A, showing straps and clips for coupling the side bolster to the frame.
Figure 9B:
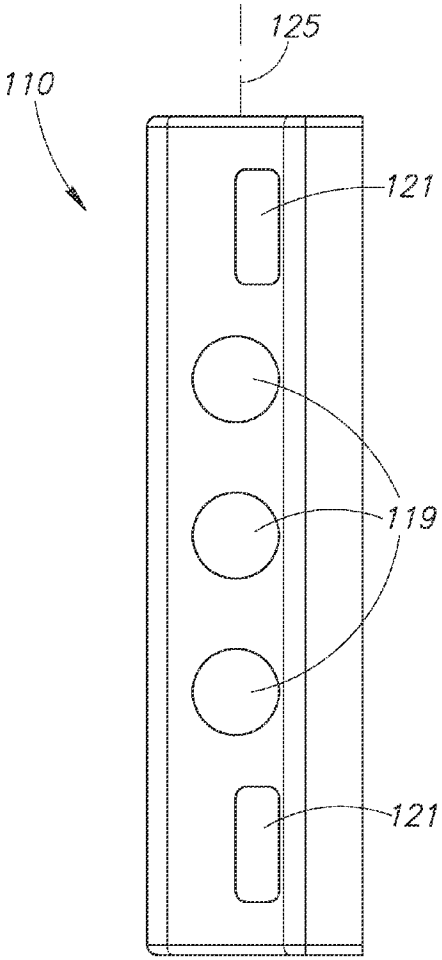
FIG. 9B is a is a side elevation view of the side bolster of FIG. 9A.

FIG. 7 shows a backpack 100 having a load compartment 102 coupled to a shoulder harness 104 and a waist belt 106. In the illustrated embodiment, the backpack includes a back pad 108 coupled to vertically oriented side bolsters 110, which are coupled to the load compartment by fastening devices 123. The fastening device 123 includes straps 115 and clips 117 coupled to the load compartment 102 on either side of side bolster 110, which is made of semi-rigid material such as high-density foam. The fastening device 123 may be disposed through slots 121 in the side bolster 110 (FIGS. 9A-9C). Alternatively, fastener devices 123 may wrap around the outside perimeter of the side bolster 110 to firmly couple the side bolsters 110 to the backpack. The load compartment 102 structurally couples to a frame 112 (FIG. 8). The backpack may further include a carrying handle 114, compression straps 116, and other accessory items that may take the form of webbing, straps, clips, zippers, pads, etc.

FIG. 8 shows the frame 112 that may be used to support the load compartment 102 according to an illustrated embodiment of the invention. The frame 112 includes flexible, yet sufficiently rigid vertically oriented stays 118 received in stitched pockets 120 of a soft covering 122. In one embodiment, the frame 112 may include a semi-rigid back plate 124 located in a lower stitched pocket 126. Further, the frame may include horizontally oriented stays 128, which may be structurally coupled or integrally formed with the vertically oriented stays 118. In the illustrated embodiment, the frame 112 is connected to the waist belt 106 and further includes connection devices 130 for coupling to the load compartment 102.

The illustrated frame 112 is commonly referred to as a "soft-frame" because the stays are flexible enough to form and generally move with the wearer, yet structurally strong and stiff enough to support the load compartment 102, shoulder harness 104, and waist belt 106 even when the load compartment 102 contains a substantial amount of weight, for example more than thirty pounds (30 lbs.). The length, width, thickness, and material of the stays 118, 128 may be selected depending on a desired purpose of the backpack 100.

FIGS. 9A-9C show side bolster 110 according to an illustrated embodiment of the present invention. When clips 117 are engaged through slots 121 to couple side bolsters 110 to frame 112, it provides structural stability for the purpose of cooperating with the frame 112 (FIG. 8) and helping to stabilize the load compartment 102 (FIG. 7) of the backpack 100. According to a presently preferred embodiment, three channels 119 are formed laterally through side bolster 110 to allow air flow in a direction away from or toward the backpack and the backside of the wearer. The channels 119 may have circular, oval, or rectangular cross-sections with varying dimensions. The area formed by channels 119 is sufficient large enough to allow air flow and sufficiently small enough to allow side bolsters 110 to structurally cooperate with the frame. Alternatively, channels 119 may be a plurality of smaller channels.

Slots 121 are formed laterally through side bolster 110 to receive the fastening devices 123 when coupling the side bolsters to the backpack (FIG. 9C). The straps 115 and clips 117 (fastening devices 123) are releasable by squeezing clips 117 on either side of slot 121, which allows quick removal of the side bolsters from the backpack. As shown in FIG. 9C, one end of clip 117 includes a releasing mechanism that is positioned within slot 121 and slightly exposed beyond the perimeter of the side bolster. When squeezed inwardly and against the other end of the clip, the releasing mechanism releases clip 117 from the side bolster, thereby allowing removal of the side bolster from the backpack. Clip 117 is therefore releasable on the ends of the clip, as opposed to the side of the clips as with conventional clip systems. This configuration further provides structural support when the fastening devices secured the side bolster to the frame. Slots 121 are formed above and below channels 119 in a manner to provide structural stability backpack. It will be appreciated that other fasteners and means may be used for securing and releasing side bolsters 110 from the backpack through slots 121 or around the perimeter of the side bolsters.

Figure 10:
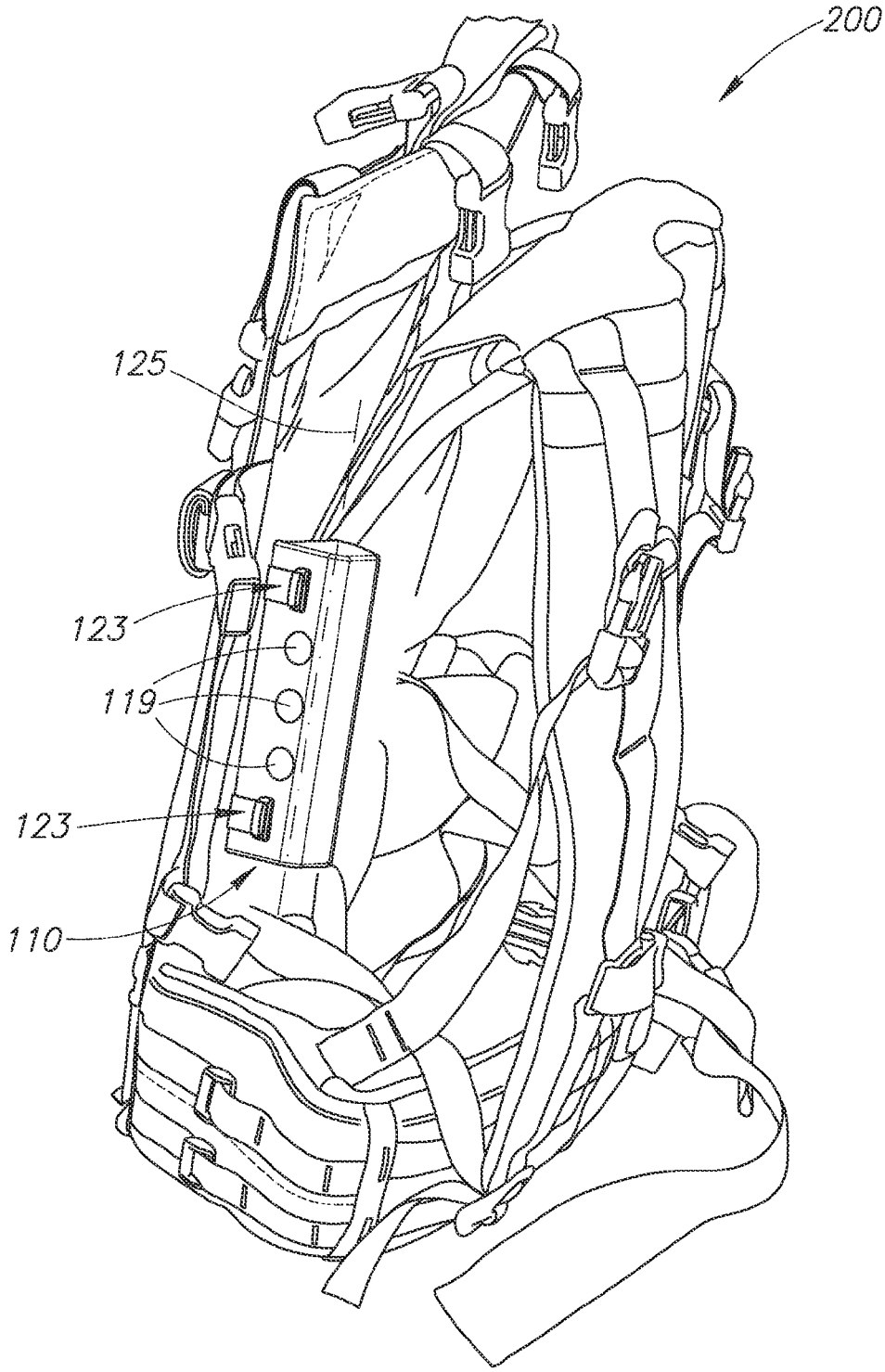
FIG. 10 is a side perspective view of the backpack having a side bolster according to an illustrated embodiment of the present invention of FIG. 7.

The side bolsters 110 have a center axis 125 oriented substantially vertically to structurally cooperate with frame 112 in providing stability for the load compartment 102. The center axes 125 of side bolsters 110 are spatially separated in a forward direction from the forward surface of frame 112 that is laterally adjacent bolsters 110 (FIGS. 7 and 10). The side bolsters 110 thereby contour around the backside of the wearer to provide stability for the load compartment and to provide ventilation.

FIG. 9C illustrates the configuration of straps 115 and clips 117 as coupling side bolster 110 to the backpack. The upper slot 121 shows straps 115 and clips 117 in the disengaged state near the slot. The lower slot 121 shows straps 115 and clips 117 in the engaged state disposed through slot 121, whereby clips 117 extend through the length of slot 121.

The side bolsters 110 may be comprised of various semi-rigid materials having various densities to help stabilize the backpack 100 with respect to the wearer. According to a presently preferred embodiment, side bolsters 110 are comprised of high-density foam having a range of density of approximately 0.5 lbs/ft$^3$ to 10.0 lbs/ft$^3$, in a more preferred embodiment the range of density is 2.0 to 4.0 lbs/ft$^3$. Side bolsters 110 may alternatively be constructed of other materials. Closed or open cell materials may be used, including rubber or polymers. The density can be selected based on the load to be carried. The stiffness may vary based on the selection of the bolster material as well. The material may be progressively more dense or stiff as it extends away from the back of the user or may vary vertically in compressibility. Various materials and material arrangements may be employed to meet the needs of the load and the user.

FIG. 10 shows backpack 100 coupled to side bolsters 110 by fastening devices 123 according to an illustrated embodiment of the present invention. The center axes 125 or at least the forward-most portions of the side bolsters are spatially separated in a forward direction from the forward surface of the frame medially adjacent the bolsters, whereby the side bolsters 110 are provided to contour around the backside of the wearer to provide stability for the load compartment and ventilation.

In a presently preferred embodiment, each side bolster assembly includes at least four straps 115 that are secured to frame 112 by stitching the ends of straps 115 to the fabric of frame 112. As described above, one pair of straps is secured to the frame near the upper portion of the side bolster, and another pair of straps is secured near the lower portion of the side bolster. Straps 115 are therefore secured to frame 112 behind side bolster 110 when it is secured to the frame by virtue of engaging clips 117 to one another (FIG. 9C). This arrangement of the straps and clips strongly secures the side bolsters to the frame and prevents rotation and shifting of the side bolsters while wearing the backpack, which further adds to the stabilization of the backpack.

Fastening devices 123 may include a plurality of straps and clips extending vertically over a substantial portion of the backpack 110 to provide additional structural support. Alternatively, two or more side bolsters 110 may be stacked vertically on one side of the back pad 108. In a preferred embodiment, fastening devices 123 firmly secure side bolsters 110 to load compartment 102 to provide structural stability to the system. Another purpose of side bolsters 110 is to offset or space the backpack 100 away from the back of the wearer. In one application, the side bolsters 110 have been found to be advantageous on military-style backpacks to stabilize the backpack 100 while maintaining the backpack 100 away from or nested and contoured with an armored plate (not shown) worn on the backside of a soldier (not shown).

Figure 11:
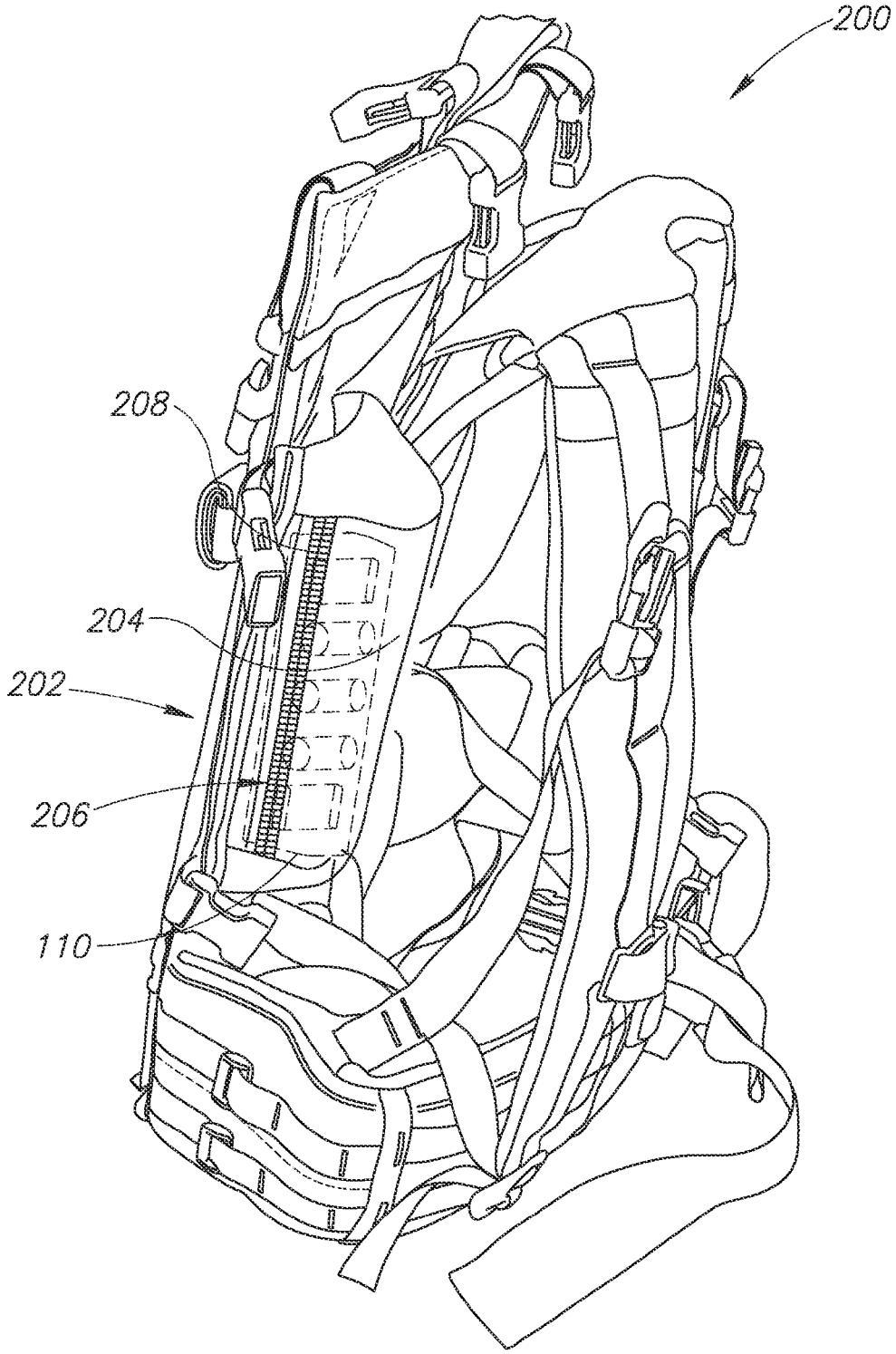
FIG. 11 is a side perspective view of a backpack having a side bolster made of semi-rigid material contained in a sleeve according to another illustrated embodiment of the present invention.

FIG. 11 shows an alternate preferred embodiment wherein the side bolsters 110 are received in elongated, breathable sleeves 111 (the sleeves as shown in FIG. 1). The bolstered ventilation and stabilization system 202 includes side bolsters 110 received in breathable sleeves 204. The breathable sleeve 204 includes an access system 206 for gaining access to inside the sleeve 204, and specifically for gaining access to side bolsters 110 for insertion or removal. In the illustrated embodiment, the access system 206 takes the form of a side zipper 208 extending along at least a substantial length of the sleeve 204. However, the access system 206 may take other forms such as a top flap, top or bottom zipper, an internal zipper accessible from within the backpack 200, or other equivalent embodiments.

The sleeves 204 may extend vertically over a substantial portion of the backpack 100 or may be truncated to have a shorter height, for example a height approximately equivalent to a height of the waist belt 106. Further, the sleeves 111 may take the form of a plurality of sleeves vertically aligned with one another and extending over the substantial portion of the backpack 100 or may be arranged in other configurations on the backpack 100. In one embodiment, the sleeves 204 are made from a woven fabric in which the selected weave pattern permits a substantial amount of airflow through the sleeves 204. Slots 121 of the side bolster 110 may not be necessary in this embodiment, but they may improve ventilation in cooperation with channels 119.

The backpack with side bolsters according to any of the embodiments described above may advantageously improve or enhance ventilation to the wearer's backside and may advantageously cooperate with the frame to increase the stability of the load compartment of the backpack. In addition, the side bolsters may be arranged to replace rigid plastic extension members located near the hip belts on some backpacks.

Embodiments of the present invention also include a method of stabilizing the backpack by engaging the clips to secure the side bolsters to the frame of the backpack, including the step of releasing the clips to remove the side bolsters, as previously described in connection with FIGS. 7-11.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A stabilizing system for a backpack, the stabilizing system comprising:

a back pad coupled to the backpack, the back pad having a surface oriented substantially vertical, whereby the surface is provided to rest against the backside of a wearer;

a pair of side bolsters made from a rigid material;

a pair of sleeves coupled to the back pad and sized to receive the pair of side bolsters, the sleeves horizontally spaced apart from each other by approximately the width of the back pad and the sleeves oriented approximately vertically, the sleeves made from a breathable material, the side bolsters are respectively arranged in the sleeves to provide an amount of structural stabilization to the backpack, the side bolsters cooperate with the sleeves to move air from the back pad area and away from the spaced apart region formed by the sleeves in a direction away from the back pad; and wherein an axis of each of the side bolsters is spatially separated in a forward direction from the surface of the back pad, whereby the side bolsters, in combination with the back pad, contour around the backside of the wearer to provide stability for the backpack and to provide ventilation.

2. The stabilizing system of claim 1, wherein the rigid material is high-density foam.

3. The stabilizing system of claim 1, wherein the side bolster include at least one channel disposed horizontally in the side bolster to allow air flow through the side bolster in a direction away from the forward surface of the backpack or the wearer.

4. The stabilizing system of claim 3, wherein the channel is formed in a circular or oval cross-section to provide stabilizing support for the backpack while allowing air flow in a direction away from the forward surface of the backpack.

5. The stabilizing system of claim 1, wherein the sleeve includes a zipper for opening the sleeve to access the side bolsters.

6. The stabilizing system of claim 1, wherein side bolsters cooperate with the frame to provide an amount of stabilizing support for the backpack when the load compartment is loaded.

7. A backpack comprising:

a frame, the frame having a substantially vertical forward surface with two lateral sides, whereby the forward surface is provided to rest adjacent the backside of a wearer;

a load compartment coupled to the frame rearward of the forward surface;

shoulder straps coupled to the frame;

a pair of side bolsters each coupled to the frame by a pair of fastening devices, the side bolsters each having a center axis oriented substantially vertically to structurally cooperate with the frame in providing stability for the load compartment, wherein the side bolsters are comprised of semi-rigid material;

a plurality of channels formed laterally through the side bolsters to allow air flow through the side bolsters;

at least one pair of fastening devices coupled to the frame, the fastening device comprising a pair straps secured to the frame on one end, the straps having a clip on the other end of each strap for coupling the side bolster to the frame or releasing the side bolster from the frame, wherein the clips are disposed laterally through at least one slot in the side bolster; and wherein the side bolsters extend forward of the forward surface of the frame, whereby the side bolsters are provided to contour around the backside of the wearer to provide stability for the load compartment.

* * * * *